United States Patent [19]

Ige

[11] Patent Number: 5,056,749

[45] Date of Patent: Oct. 15, 1991

[54] RECEPTACLE AND COASTER ASSEMBLY

[76] Inventor: Frank T. Ige, 175 Tigertail Rd., Los Angeles, Calif. 90049

[21] Appl. No.: 601,420

[22] Filed: Oct. 23, 1990

[51] Int. Cl.[5] ..... A47B 91/00

[52] U.S. Cl. ..... 248/346.1; 220/630

[58] Field of Search ..... 248/346.1, 311.2; 220/625, 630; 215/100.5, 100 A

[56] References Cited

U.S. PATENT DOCUMENTS

| | | | |
|---|---|---|---|
| 2,641,911 | 6/1953 | Raymond et al. | 248/346.1 |
| 2,963,256 | 12/1960 | Borah | 248/346.1 |
| 4,591,066 | 5/1986 | Moen | 220/630 X |
| 4,756,497 | 7/1988 | Lan | 248/346.1 X |
| 4,907,712 | 3/1990 | Stempin | 220/630 |

*Primary Examiner*—Carl D. Friedman
*Assistant Examiner*—Korie H. Chan
*Attorney, Agent, or Firm*—Beehler & Pavitt

[57] ABSTRACT

A removable coaster for attachment onto a receptacle such as a cup for example, having a hole on the coaster bottom for easy removal thereof. The coaster having a circumference less than the circumference of the receptacle in order to force fit the coaster onto the bottom portion of the receptacle so that the wall of the coaster is flush with the wall of the receptacle.

6 Claims, 1 Drawing Sheet

RECEPTACLE AND COASTER ASSEMBLY

BACKGROUND OF THE INVENTION

I. Field of the Invention

This invention relates generally to a receptacle and coaster assembly. More specifically, this invention relates to a coaster which is adapted to be fixed with respect to the receptacle and to provide the function of precluding the escape from the surfaces thereof of condensate and moisture or overflowing liquid which might gravitate to the lower portion of the receptacle.

II. Description of the Related Art

Coasters for containers have long been used to protect table surfaces by preventing condensation or spills from coming in contact with the table surface. Also, many such coasters have been adapted to be fixed with respect to the containers. The means by which the coaster has previously been fixed to the receptacle include the coaster having vertical slots connecting with circumferential slots in the receptacle having outwardly directing tabs (U.S. Pat. No. 4,040,549), the coaster having a series of vertical resilient gripping tongues to engage the bottom of the receptacle (U.S. Pat. No. 1,957,263), the annular wall of a coaster moving radially in or out in response to pressure being placed on the bottom surface of the coaster and thereby providing a gripping action of the annular wall on the receptacle (U.S. Pat. No. 2,963,256) projections on the top wall of the coaster for gripping the receptacle (U.S. Pat. No. 2,727,645), the coaster having a short barb which engages the side walls of a specially formed receptacle (U.S. Pat. No. 4,775,063), and a combination receptacle and coaster having a groove end bead attachment (U.S. Pat. No. 3,079,037).

The patents in this area make evident the many attempts to create a coaster which can be fixed to a receptacle which is practical, convenient, and neat in appearance.

SUMMARY OF THE INVENTION

This invention provides for a coaster that is adapted to be elastomerically retained to a receptacle, such as a coffee cup.

A coaster is provided with resilient and flexible side walls having an inside circumference which is slightly less than the outside circumference of the lower portion of the receptacle which it retains. The side walls are slightly stretched to allow the lower portion of the receptacle to be placed therein. The resiliency of the side wall acts to retain the coaster about the receptacle.

This invention further provides a coaster adapted to grip a surface upon which it is placed. Preferably, this is accomplished by the bottom surface of the coaster being of a material which frictionally grips the surface.

The coaster of this invention is provided with means to be easily removed from the receptacle. Quick and easy removal of the coaster allows both coaster and receptacle to be conveniently cleaned.

A preferred embodiment of this invention allows the coaster to be removed easily by providing a hole in the bottom of the coaster which creates a lip that can be easily manipulated by a finger or thumb.

In a preferred embodiment, the outer walls of the coaster and the receptacle are cylindrical. Further, the hole in the bottom of the coaster is preferably circular and concentric with the side wall of the coaster.

This invention further provides for a coaster whose outer walls are flush with the outer walls of the receptacle which is placed therein, thus providing a neat and attractive appearance. One means of creating these flush walls is to provide a receptacle with a lower portion having a reduced perimeter around which the coaster is placed.

This invention further provides a convex indentation integrally formed on the bottom surface of the receptacle adjacent the previously mentioned hole in the coaster which assists in allowing the coaster to be easily removed from the receptacle.

BRIEF DESCRIPTION OF THE DRAWINGS

The objectives, advantages, and applications of the present invention will be made apparent by the following detailed description of the preferred embodiment of the invention. The description makes reference to the accompanying drawings in which.

DETAILED DESCRIPTION OF THE PREFERRED EMBODIMENT

Figure 1:
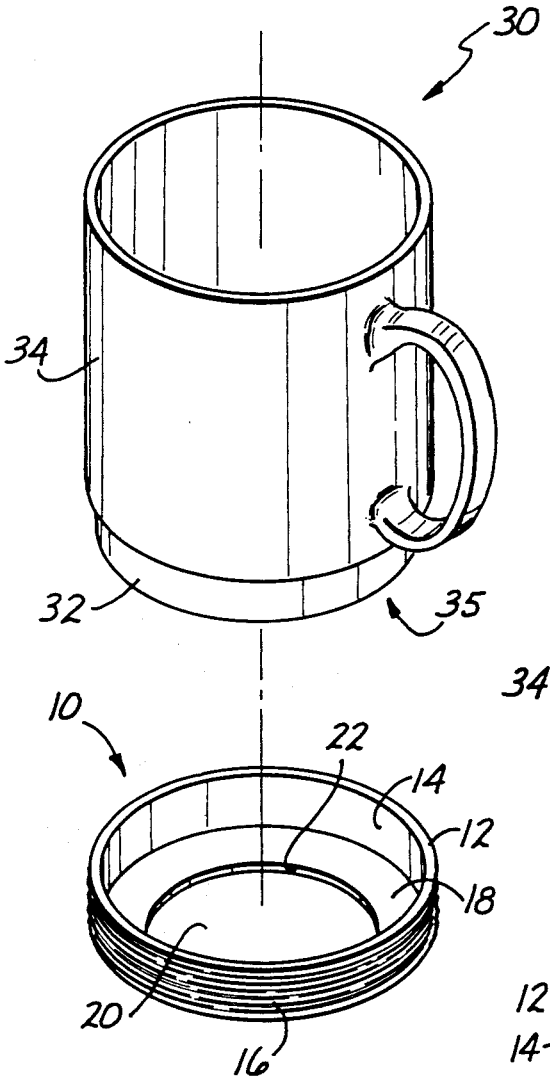
FIG. 1 is an exploded perspective view of the coffee cup and attached coaster portion of a preferred embodiment of this invention.
Figure 2:
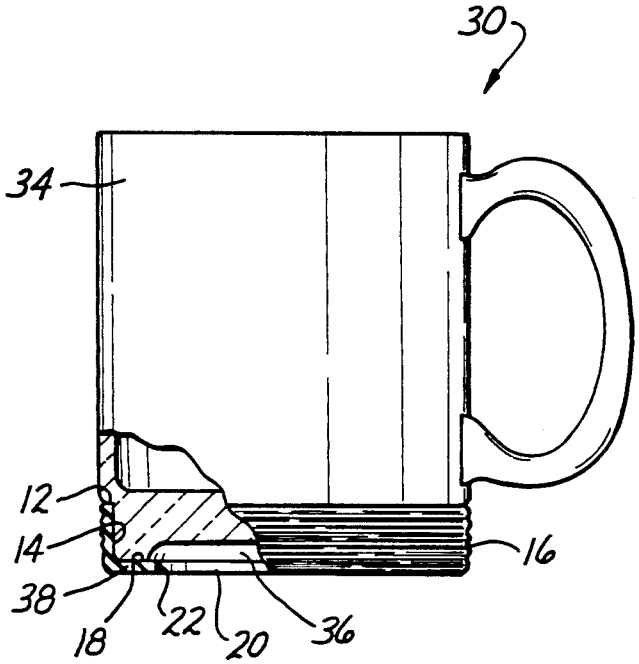
FIG. 2 is a side view of the coffee cup and unattached coaster of the preferred embodiment of this invention, with a partially broken view showing a cross section of the points of attachment.

Coaster 10 is used to support and contain a receptacle. Coaster 10 is preferably made of a resilient and flexible material, such as rubber. The L-shaped cross section of coaster 10 is shown in FIG. 2. The side wall 12 is preferably circular and includes an inner surface 14 and an outer surface 16. Side wall 12 is integrally formed with bottom 18. Preferably, a large circular hole 20 is provided in the bottom creating the circular flange 18 which extends inwardly from the perimeter defined by side wall 12. The resulting lip of inner edge 22 of the bottom circular flange 18 provides a convenient means to grasp the coaster.

The receptacle, as will be understood, could be a pot, cup, can, or any such receptacle requiring a holder or coaster of the type referred to herein. In the preferred embodiment, the receptacle is a coffee cup 30. Coffee cup 30 preferably has a cylindrical upper portion 34 with a constant diameter. Cup 30 also has a cylindrical lower portion 32 with a diameter slightly less than the upper portion diameter 34. The radius of the circle defined by upper perimeter 34 is preferably approximately equal to the radius of the circle defined by lower perimeter 32 plus the thickness of side wall 12. Cup 30 is further preferably provided with a circular concave depression 36 within an annular rim 38 on its bottom surface. Holder 10 is assembled in position on cup 30 by positioning bottom 18 against surface 38. In order to do this, side wall 12 must be slightly stretched to accommodate the perimeter of lower portion 32. When in position, inner surface 14 of side wall 12 is in contact with the outer surface of lower portion 32 and outer surface 16 of side wall 12 is flush with outer surface of upper portion 34. Holder 10 is thus retained in the desired operative position by elastomeric frictional engagement with lower portion 32.

Hole 20 is concentric with indentation 36. This allows easy removal of holder 10 by a user who grasps lip 22 which protrudes slightly over annular rim 38.

Outer surface 6 of coaster is provided with ridges or such other designs as to allow for a neat appearance when placed adjacent to outer surface of upper portion 34 of cup 30.

In an alternative embodiment the coaster side wall 12 and the lower portion 32 may form any shape as long as they are both approximately the same shape and the perimeter of side wall 12 is slightly less than the perimeter of lower portion 32 so that elastomeric frictional engagement alone will hold them together. There are, of course, many obvious alternative embodiments and modifications to this embodiment which are intended to be included within the scope of the following claims.

I claim:

1. A coaster for removable attachment to a receptacle, said coater comprising:

a generally flat bottom, said flat bottom comprising gripping means for gripping a supporting surface onto which said coaster is placed and easy removal means for easily separating said coaster from said receptacle, said easy removal means comprising a hole in said generally flat bottom, said hole being bounded by an inner edge which is adapted to be easily grasped by a user;

a resilient and flexible side wall integrally formed with, and extending generally perpendicularly from the perimeter of said flat bottom; the inside circumference of said side wall being slightly less than the outside circumference of a lower portion of said receptacle, said side wall being adapted to elastomerically retain said lower portion of said receptacle.

2. A combination receptacle and coaster wherein said coaster has a generally flat bottom and a resilient and flexible side wall integrally formed therewith, and extending generally perpendicularly from the perimeter of said flat bottom, said flat bottom comprising gripping means for gripping a supporting surface onto which said coater is placed and easy removal means for easily separating said coaster from said receptacle, said easy removal means comprising a hole in said generally flat bottom, said hole being bounded by an inner edge which is adapted to be easily grasped by a user, the inside circumference of said side wall being slightly less than the outside circumference of a lower portion of said receptacle, said side wall being adapted to elastomerically retain said lower portion of said receptacle.

3. The combination of claim 2 wherein said easy removal means further comprise a generally concave indentation integrally formed on the bottom of said receptacle, said indentation being concave with respect to said flat bottom and adapted to provide space for a user to easily grip said inner edge of said flat bottom.

4. The combination of claim 2 wherein an upper portion of the outside surface of the receptacle wall and the outside surface of said coaster side wall define therebetween a generally continuous flush surface.

5. The combination of claim 4 wherein said upper portion of the outside surface of said receptacle has a configuration which is generally the same as the configuration of the outside surface of said coaster wall and the lower portion of said receptacle has a reduced perimeter which is adapted to be received in, and retained by, said coaster.

6. The combination of claim 2 wherein the receptacle is a cup having a generally circular configuration.

* * * * *